US005131791A

United States Patent [19]

Kitziller

[11] Patent Number: 5,131,791

[45] Date of Patent: Jul. 21, 1992

[54] RETAINING WALL SYSTEM

[75] Inventor: James K. Kitziller, Dallas, Tex.

[73] Assignee: Beazer West, Inc., Dallas, Tex.

[21] Appl. No.: 615,424

[22] Filed: Nov. 16, 1990

[51] Int. Cl.[5] ..... E02D 29/02

[52] U.S. Cl. ..... 405/286; 405/262

[58] Field of Search ..... 405/258, 262, 272, 284, 405/285, 286

[56] References Cited

U.S. PATENT DOCUMENTS

| | | | |
|---|---|---|---|
| D. 243,613 | 3/1977 | Hilfiker | D25/77 |
| D. 243,697 | 3/1977 | Hilfiker | D25/77 |
| D. 288,616 | 3/1987 | Hilfiker | D25/80 |
| D. 296,934 | 7/1988 | Sosno et al. | D25/5 |
| D. 299,510 | 1/1989 | Sosno et al. | D25/5 |
| 982,698 | 1/1911 | Upson . | |
| 1,702,261 | 2/1929 | Mimaki et al. . | |
| 1,909,539 | 5/1933 | Huntoon . | |
| 1,953,005 | 3/1934 | Nagel | 61/47 |
| 3,111,060 | 11/1963 | Peeling | 87/13 |
| 3,421,326 | 1/1969 | Vidal | 61/39 |
| 3,686,873 | 8/1972 | Vidal | 61/39 |
| 3,877,236 | 4/1975 | O'Neill et al. | 61/47 |
| 3,922,864 | 12/1975 | Hilfiker | 61/35 |
| 3,953,979 | 5/1976 | Kurose | 405/286 |
| 3,981,038 | 9/1976 | Vidal | 14/26 |
| 4,045,965 | 9/1977 | Vidal | 61/39 |
| 4,051,570 | 10/1977 | Hilfiker | 14/26 |
| 4,067,166 | 1/1978 | Sheahan | 52/593 |
| 4,068,482 | 1/1978 | Hilfiker | 61/47 |
| 4,111,401 | 9/1978 | Pickett | 256/13.1 |
| 4,116,010 | 9/1978 | Vidal | 405/262 |
| 4,117,686 | 10/1978 | Hilfiker | 405/284 |
| 4,125,970 | 11/1978 | Vidal | 52/31 |
| 4,138,947 | 2/1979 | Pickett | 104/1 R |
| 4,141,184 | 2/1979 | Vidal | 52/169.4 |
| 4,154,554 | 5/1979 | Hilfiker | 405/273 |
| 4,192,249 | 3/1980 | Vidal | 114/61 |
| 4,196,161 | 4/1980 | Toffolon et al. | 264/71 |
| 4,214,411 | 7/1980 | Pickett | 52/144 |
| 4,260,296 | 4/1981 | Hilfiker | 405/284 |

(List continued on next page.)

FOREIGN PATENT DOCUMENTS

| | | |
|---|---|---|
| 2286243 | 9/1974 | France . |
| 2409351 | 11/1977 | France . |
| 0085426 | 5/1982 | Japan . |

OTHER PUBLICATIONS

Doublewal Corporation, *Design Manual, Doublewal Interlocking Reinforced Concrete Retaining Wall System*, 1982.

Tensar Corporation, *TENSAR Concrete GeoWall Package, Reinforced Soil Retaining Wall Systems*, (Promotional Brochure) 1987.

Spillman Forum, News about the precast/prestressed concrete industry, vol. XI, No. 2, Spring 1988.

"MKE-Designed Wall Joins Battle to Contain Great Salt Lake in Utah", *The eM-Kayan*, Jan. 1986.

The Hilfiker Corporation, *Hilfiker Welded Wire Walls*, (List continued on next page.)

*Primary Examiner*—David H. Corbin

*Attorney, Agent, or Firm*—Johnson & Gibbs

[57] ABSTRACT

A retaining wall system comprising a combination of gravity wall and soil reinforcement retaining wall structures. The gravity wall structure comprises a plurality of gravity wall members formed of pre-cast or cast-in-place concrete, each including a face panel and an anchoring member. The anchoring member is disposed in a generally orthogonal relationship relative to the face panel and extends rearwardly into the soil mass behind the retaining wall. The soil reinforcement members are comprised of face panels and soil reinforcement elements extending rearwardly therefrom into the soil mass for the securement of the face panels. The soil reinforcement members are further adapted for positioning the gravity wall members to facilitate the economical construction of a combination retaining wall, having the most advantageous form of retaining wall securement for the upper and lower regions thereof.

22 Claims, 3 Drawing Sheets

U.S. PATENT DOCUMENTS

| | | | |
|---|---|---|---|
| 4,266,890 | 5/1981 | Hilfiker | 405/286 |
| 4,269,537 | 5/1981 | O'Neill | 405/29 |
| 4,324,508 | 4/1982 | Hilfiker et al. | 405/284 |
| 4,329,089 | 5/1982 | Hilfiker et al. | 405/262 |
| 4,343,572 | 8/1982 | Hilfiker | 405/284 |
| 4,380.409 | 1/1983 | O'Neill | 405/273 |
| 4,384,810 | 5/1983 | Neumann | 405/284 |
| 4,391,557 | 7/1983 | Hilfiker et al. | 405/287 |
| 4,412,760 | 11/1983 | Vidal | 405/267 |
| 4,440,527 | 4/1984 | Vidal | 405/284 |
| 4,449,857 | 5/1984 | Davis | 405/286 |
| 4,470,728 | 9/1984 | Broadbent | 405/284 |
| 4,494,892 | 1/1985 | Wojciechowski | 404/6 |
| 4,505,621 | 3/1985 | Hilfiker et al. | 405/284 |
| 4,514,113 | 4/1985 | Neumann | 405/286 |
| 4,529,174 | 7/1985 | Pickett | 256/27 |
| 4,557,634 | 12/1985 | Vidal | 405/286 |
| 4,564,967 | 1/1986 | Vidal | 405/285 |
| 4,594,023 | 6/1986 | O'Neill | 405/29 |
| 4,616,959 | 10/1986 | Hilfiker | 405/286 |
| 4,618,283 | 10/1986 | Hilfiker | 405/124 |
| 4,619,560 | 10/1986 | Crinnion et al. | 405/284 |
| 4,653,962 | 3/1987 | McKittrick et al. | 405/286 |
| 4,661,023 | 4/1987 | Hilfiker | 405/262 |
| 4,668,958 | 5/1987 | Keiser | 343/916 |
| 4,684,287 | 8/1987 | Wojciechowski | 404/6 |
| 4,684,294 | 8/1987 | O'Neill | 405/286 |
| 4,710,062 | 12/1987 | Vidal et al. | 405/262 |
| 4,725,170 | 2/1988 | Davis | 405/286 |
| 4,728.227 | 3/1988 | Wilson et al. | 405/284 |
| 4,770,564 | 9/1988 | Dison | 405/286 |
| 4,790,690 | 12/1988 | Vidal et al. | 405/262 |
| 4,804,299 | 2/1989 | Forte et al. | 405/285 |
| 4,818,150 | 4/1989 | Jaecklin | 405/262 |
| 4,824,293 | 4/1989 | Brown et al. | 405/284 |
| 4,826,639 | 5/1989 | Vidal et al. | 264/32 |
| 4,834,584 | 5/1989 | Hilfiker | 405/262 |
| 4,856,939 | 8/1989 | Hilfiker | 405/284 |
| 4,874,272 | 10/1989 | Egan | 405/284 |
| 4,904,124 | 2/1990 | Egan | 405/262 |
| 4,911,585 | 3/1990 | Vidal et al. | 405/287 |
| 4,914,876 | 4/1990 | Forsberg | 52/169.4 |
| 4,929,125 | 5/1990 | Hilfiker | 405/262 |
| 4,929,125 | 5/1990 | Hilfiker | 405/262 |
| 4,953,280 | 9/1990 | Kitzmiller | 29/412 |

FOREIGN PATENT DOCUMENTS (promotional brochure), May 1984.

The Hilfiker Corporation, *Hilfiker Reinforced Soil Embankment (promotional brochure–not dated).*

Beton Schmitt, *Kleinostheim* (promotional brochure/-catalog–not dated).

"The Many Types of Concrete Retaining Walls," *Concrete Construction,* Jul. and Aug. 1987.

RETAINING WALL SYSTEM

BACKGROUND OF INVENTION

1. Field of Invention

The present invention relates to retaining walls and, more particularly, to concrete retaining wall systems of the gravity wall and soil reinforcement type.

2. History of the Prior Art

Retaining walls have been used for centuries to establish earthen contours and prevent soil mass from moving into areas adjacent the wall. Such structures are often used near roads, bridges, highways and other areas of both pedestrian and vehicle traffic to control rock, dirt, debris, and sand adjacent thereto. Retaining walls are also used in construction to secure a region of soil for purposes of foundational support. The type of retaining wall obviously depends upon the particular application and the amount and type of soil mass being retained. For this reason, the material used in and the design for retaining walls typically change from application to application.

Retaining walls can be found in a variety of shapes, sizes and styles. The walls that are used in residential areas often incorporate rocks or wooden beams, such as railroad cross ties. In certain situations, select cross ties are turned orthogonally into the soil mass (called "dead men") to secure the retaining wall. Commercial structures along highways, bridges and the like conventionally incorporate more complex pre-cast concrete configurations with elaborate securement systems. These concrete assemblies generally present a substantially planar face, which may be of considerable height and behind which soil or rock is secured in volumes that can generate larger loads against the retaining wall. In most instances, the concrete face is secured by a number of securement members which are carefully designed relative to the structural load associated therewith and which extend deeply into the soil mass. Such securement members are conventional in retaining wall technology and are used to prevent the retaining wall from moving or breaking as a result of static loads or movement of the soil mass.

Retaining wall designs date back into technological antiquity. Even early retaining walls had some anchoring technique, such as the "dead men" referenced above. These anchors are designed to carry some of the weight of the soil behind the retaining wall and resist the overturning moment of the soil against the wall itself. This rather basic structural loading technique is also seen in bookends, where the weight of the book upon a first horizontal, of two orthogonal members, prevents the upstanding vertical member from overturning by the transverse force of the book. By utilizing this basic structural theory in retaining walls, a myriad of retaining wall designs and assembly systems have been developed and the materials utilized have evolved into complex concrete structures.

Subsequent wall systems formed of concrete were constructed with forms assembled at the retaining wall site. The advent of the pre-cast system of concrete construction antiquated some of these designs because less excavation and traffic interruption resulted from the use of pre-cast technology. This is particularly true with the expansive highway systems of today, where retaining walls are used around and against the sides of the highway which must be kept open. With such technology, highway expansion can stay within permitted right-of-ways; traffic congestion is reduced and the environmental effect of the highway can be minimized in parks and other environmentally sensitive areas.

Today, retaining wall systems utilize sophisticated applications of civil engineering. The various members may be specifically designed for particular applications, pre-cast, delivered to the retaining wall site, and installed in a configuration that is much less expensive than pour in situ techniques. Much of the concrete retaining wall construction conventionally used today is shown in prior art patents. These patents vary in their time frames and in technological sophistication. For example, U.S. Pat. No. 982,698 issued to M. M. Upson is a 1911 patent addressing early concrete retaining wall construction. As is set forth in this reference, such retaining walls are used for docks, railroad embankments, bridges, etc., where dirt, rock or fluids need to be retained. U.S. Pat. No. 1,702,610 teaches a generally T-shaped retaining wall member whose top wall surface gradually increase in height along the rearwardly extending embedment beam. A more recent innovation is set forth and shown in U.S. Pat. No. 4,684,294, issued to O'Neil. This 1987 patent teaches another generally T-shaped cast concrete construction element having a face panel and orthogonally disposed soil embedment beam extending rearwardly therefrom and integrally formed with the face panel. Means are specifically provided for increasing the frictional resistance with the soil mass by sloping the rear wall of the embedment beam.

The above referenced patents describe retaining wall members of the gravity wall type. Other examples of gravity wall type retaining wall members are set forth and shown in several U.S. patents including U.S. Pat. No. 4,196,161, a more recent patent teaching a method for producing pre-cast monolithic concrete units with spaced apart, generally parallel walls and at least one interconnecting beam or cross member. This construction forms a generally "H" shaped member with a frontal member of substantially planar construction disposed in generally parallel spaced relationship to the rear member. U.S. Pat. No. 4,380,409 is a 1983 patent teaching a crib block for erecting bin walls. A unitary pre-cast component comprises a pair of spaced sidewalls having a central connector arm extending therebetween. The unit is constructed with the transverse thickness of the sidewalls and merger segments increasing toward the transverse center line of the unit to increase the resistance to transverse bending loads. The structural elements are shown to be provided in a plurality of lengths, longer lengths being presented at the bottom to accommodate greater forces and shorter lengths being disposed atop a stacked array. Means are provided for interlocking concrete facing panels of each structure and the pre-cast concrete blocks are said to be usable for space barriers, sound barriers, retaining walls, sea walls, dams, flood control walls, bridge abutments and the like.

Another type of retaining wall is that referred to in the industry as the soil reinforced system. These retaining wall structures also utilize a concrete face of generally planar construction, but the face is secured to the tie-back elements embedded in the soil. The tie-back elements are laid within the soil mass as the wall is constructed, and the soil mass directly provides the reinforcement to the retaining wall structure. These structures are generally more economical due to the fact that less concrete is utilized in their fabrication, they are lighter in weight and easier to ship and handle. Tie-back elements do, however, require a greater distance behind the face panel for securement than the gravity wall. A gravity wall member incorporates the weight of the embedment beam as well as the weight of the soil immediately thereabove for securement. For this reason, a great distance behind the face panel is not required for its securement. Distance is, unfortunately, often a major consideration when building retaining walls next to hills and in a limited right-of-way.

A retaining wall is very often provided in a region adjacent a hill or other sloping earthen area. In such a region, the base of the retaining wall near the slope will have a limited distance in which to provide securement of the face panels. However, the base of the retaining wall is the region which receives the greatest loading from the earthen mass which it retains. For this reason, soil reinforced retaining wall systems are not always feasible in applications with limited rearward extension distance. Even retaining walls of limited height have limitations as to the minimal amount of anchoring that is necessary for ultimate stability. When soil reinforcement retaining wall systems are used, the limitation in back depth thus becomes a limitation in the height of the wall. Such problems are not typical of gravity wall systems, which are capable of providing the requisite anchoring force by the concrete embedment beams extending therebehind. However, the advantages of soil reinforcment could be utilized if consideration was given to establishing a greater back depth.

The present invention provides an advance over the prior art by providing a retaining wall system incorporating the advantages of both gravity wall and soil reinforcement walls. The gravity wall is used in the lower region of the retaining wall where maximum force must be accommodated and minimum rear extension distance is usually found. The soil reinforcement members are mounted above the gravity wall system in a region where the loading is reduced, less rearward extension length is required, and more distance is generally available. In this manner a less expensive retaining wall assembly can be utilized with the same structural integrity as a wall system constructed soley of gravity wall members.

SUMMARY OF THE INVENTION

The present invention relates to retaining wall systems. More particularly, one aspect of the present invention incorporates a retaining wall system incorporating a gravity wall and a soil reinforcement wall system in a common retaining wall assembly. One or more frontal panels are provided for both retaining wall types, the panels being constructed for forming a substantially unitary retaining wall. In one aspect of the invention the panels may be interlocking and may be formed of a single panel style. In either design, the soil reinforcement face panels are constructed for coupling to the soil reinforcement elements for extension therebehind. The gravity wall face panels are constructed with at least one orthogonal embedment beam extending rearwardly therefrom. Various embodiments of both soil reinforcement and gravity wall elements may be utilized in accordance with the principles of the present invention.

In another aspect, the invention includes a retaining wall system comprising at least one gravity retaining wall member and one soil reinforcement retaining wall member. The gravity wall member is constructed with a face panel and a rearwardly extending embedment beam. The soil reinforcement retaining wall member includes a face panel and a rearwardly extending soil reinforcement element. Means are provided for mounting the soil reinforcement member upon the gravity wall member for the creation of a common retaining wall therebetween.

In yet another aspect, the gravity wall member described above may comprise a generally I-shaped precast concrete structure and the embedment beam may further include top, rear and bottom surfaces, the top surface being constructed with a first raised section adapted for matingly engaging the bottom surface of an embedment beam disposed thereabove. The bottom surface of the embedment beam thus includes a recessed portion adapted for matingly receiving, in interlocking engagement, the raised portion of the embedment beam disposed therebelow.

In another aspect of the invention, the above-described retaining wall system includes soil reinforcement members found with a pre-cast concrete face panel having cast therein connecting members, the connecting members being adapted for the securement of the soil reinforcement element extending rearwardly therefrom. The soil reinforcement member may comprise a metal grid adapted for soil embedment, a series of filaments adapted for soil embedment or other conventional soil reinforcement techniques. The connection members may comprise filament loops encased within the face panel, and the soil reinforcement member may comprise a plurality of wire members in a strap or an interlocking grid configuration adapted for securement to the loops. The select wires of the soil mass reinforcement member terminate along a grid engagement region in a generally arcuate shape adapted for matingly engaging the loops of the connection means. A tie rod is disposed between the loops and the arcuate wire ends for defining an interlocking relationship therebetween.

Soil reinforcement techniques for supporting concrete face panels have a myriad of approaches. Several of these are set forth and shown in the prior art patents listed above. A reinforced soil tether and a series of pre-cast concrete panels secured thereto will, in certain instances, provide all of the strength necessary for the soil backfill. With such tether arrays, the backfill soil generally available at the construction site may be utilized for the soil mass securement. This is true as long as sufficient distance is provided behind the concrete facing panel. Generally, the tie back or grid material is corrosion resistant and once properly secured to the facing panel may be used in a myriad of applications. As stated above, the primary limitation for use of such panels is the base width, or that spacing behind the panel to which the reinforced grid can be extended. This is a particularly critical consideration when addressing cut slopes because the overall stability of the slope with the wall in place must be carefully analyzed.

In the construction of such soil reinforced assemblies, each grid is backfilled and compacted with soil prior to the extension of the next adjacent grid thereabove. With each extension and soil compaction of the grids, an assembly is provided that can accommodate sliding and overturning loads that may be readily calculated by the properties of the soil and the size of the grid associated therewith.

In another aspect, the above-described invention may include face panels which are formed from concrete, with an interlocking lip formed therearound, and having spacer pads disposed therebetween, the spacer pads defining a separation space between the interlocking face panels. The face panels may be constructed with at least one conduit therethrough, the conduit adapted for being vertically oriented upon assembly of the panels with the conduits in registry one with the other. In this manner the conduits may receive an alignment shaft therein to facilitate the assembly of the retaining wall.

In yet a further embodiment of the invention, an improved method of erecting a retaining wall from a plurality of pre-cast concrete face panels is provided. The method is of the type wherein face panels are secured in a generally vertical configuration and structurally secured to a soil mass disposed therebehind for maintaining the soil mass adjacent thereto. The improvement comprising the steps of providing a plurality of first face panels adapted for securement to the soil mass by a soil reinforcement member disposed rearwardly thereof and providing a plurality of second face panels adapted for securement to the soil mass by an embedment beam disposed rearwardly thereof. The plurality of second face panel and embedment beam assemblies are disposed in a first position for establishing a first, lower retaining wall section. Soil mass is then filled around and atop the embedment beam. A plurality of first face panel and soil reinforcement member assemblies are then disposed atop the panel and embedment beam assemblies. Finally, soil mass is filled around the soil reinforcement members and above the embedment beams to define a combination retaining wall comprised of embedment beams and soil reinforcement members.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
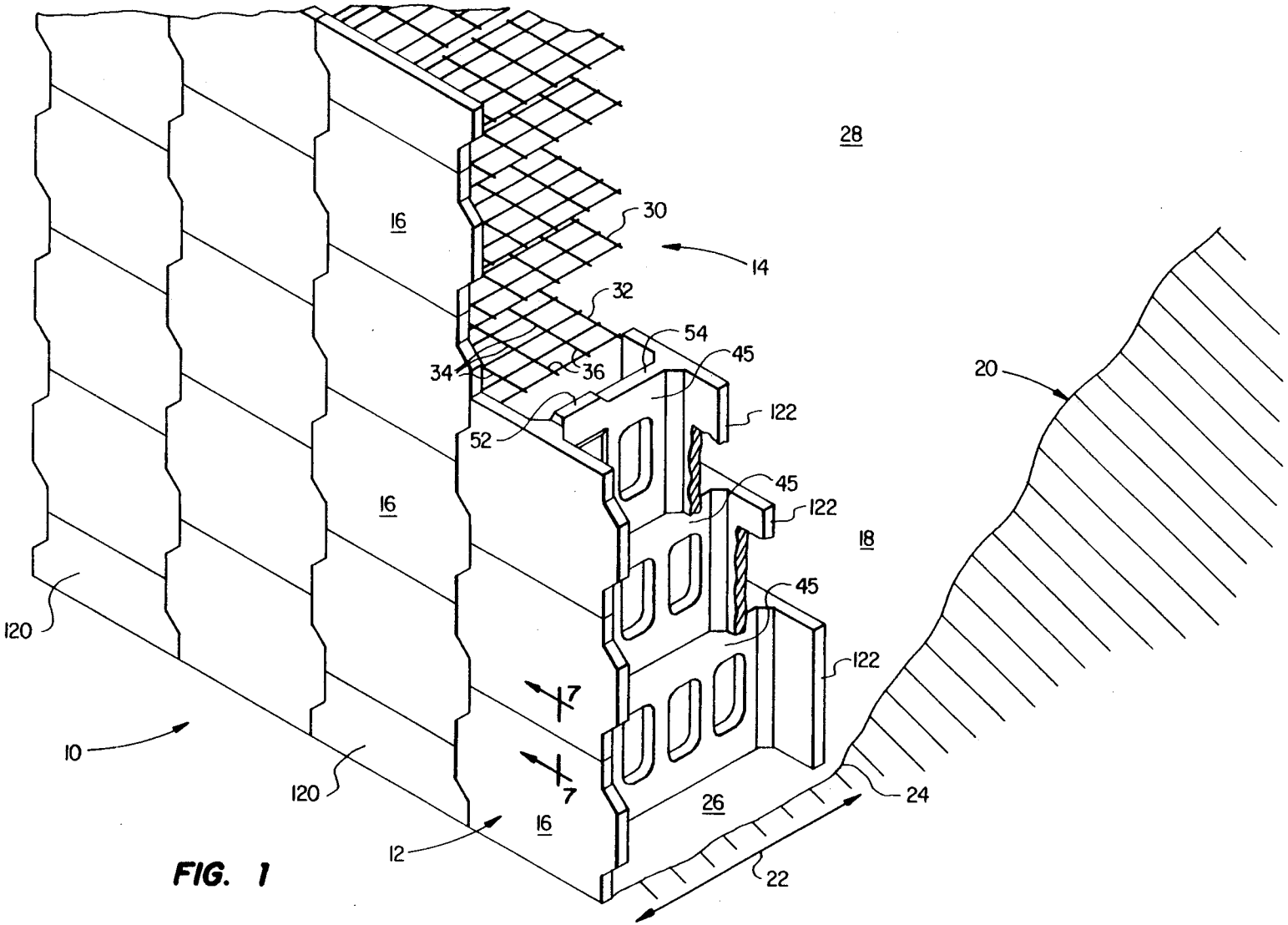
FIG. 1 is a perspective view of a retaining wall system constructed in accordance with the principles of the present invention with portions thereof cut away for illustrating the systems incorporated therewith.

Referring first to FIG. 1, there is shown a perspective view of a retaining wall assembly 10 constructed in accordance with the principles of the present invention. The retaining wall assembly 10 comprises a gravity wall system 12 forming the lower three rows of retaining wall sections. Soil reinforcement retaining wall sections 14 are positioned above the gravity wall sections 12 and comprise the top rows of the assembly 10. Each of the wall systems 12 and 14 includes a face panel 16 that is of generally planar construction having a plurality of interlocking sides which are, in this particular embodiment, of substantially identical size and shape. The face panels 16 could, of course, be of different size, shape and style in accordance with the principles of the present invention. However, the utilization of a common panel 16 presents a composite retaining wall assembly 10 and a backfill area 18 that has the appearance of a single type of retaining wall construction.

Still referring to FIG. 1, the design methodology for retaining wall systems is quite complex. A number of structural principles, including those related to soil mechanics, must be understood and considered in the design phase. External stability considerations for the retaining wall include a number of potential failure modes. These include (1) failure due to the retaining wall sliding along its base, (2) failure of the wall due to its overturning, (3) bearing capacity failure, and (4) general slope failure. It is well recognized that lateral earth pressure behind the retaining wall is the driving force which must be resisted. Contributing factors include the dead weight of the soil mass and the weight of the retaining wall block itself. These factors must be considered in determining what type of retaining wall is used and whether a gravity wall or a soil reinforced wall is appropriate. The calculation of foundation bearing stress, bearing capacity of the foundation soil, and similar constructional parameters are conventional in the art. An internal stability evaluation is also necessary for a retaining wall. The soil mass behind the retaining wall is generally divided into two regions, an active and a resistant zone, which are independently analyzed. Earth pressure will vary, of course, with the depth of the retaining wall and the design must take all these aspects into consideration.

Other features in the design must also be addressed. With external and internal stability considered, external loading conditions must be calculated. These conditions include horizontally placed backfill soil, horizontal and inclined surcharge loading, concentrated loading behind the wall and any loading from traffic or bridge abutments. The type of wall and the type of gravity wall assembly, such as "T" wall versus bin wall, varies with the consideration given to the different failure modes. For example, a bin wall will function somewhat differently than a "T" shaped retaining wall member in the overturning failure mode.

Referring still to FIG. 1, maximization of design methodology will result by the utilization of the two distinct retaining wall systems 12 and 14. The heavier retaining wall elements of the gravity wall system 12 will permit their utilization in the more narrow backfill region 18 adjacent a slope 20 as shown herein. Distance 22 between the front of the face panel 16 and the end 24 of the slope 20 as it engages the generally level surface 26 would in most instances be too short for a retaining wall system having the number of vertical panels displayed herein. However, the structural stability of the gravity wall system 12 provides adequate structural integrity to resist sliding, overturning, and/or general slope failure when constructed with conventional civil engineering principles and retaining wall technology. Thus the region 28 disposed above the gravity wall members may be seen to provide a much greater distance behind retaining wall face panel 16 for the placement of soil reinforcement members 30, also referred to herein as a tether array. In the present illustration, the soil reinforcement member 30 is comprised of a series of sheets 32 which may be formed of steel, wire or the like. Sheet 32 is comprised of a plurality of rearwardly extending wires 34 secured to transversely extending wires 36 creating a generally rectangular grid pattern. There are a number of conventional soil reinforcement techniques which may be used and these may include straps, lines, cables and similar securement tethers, many of which are set forth and described in the prior art patents discussed above.

Figure 2:
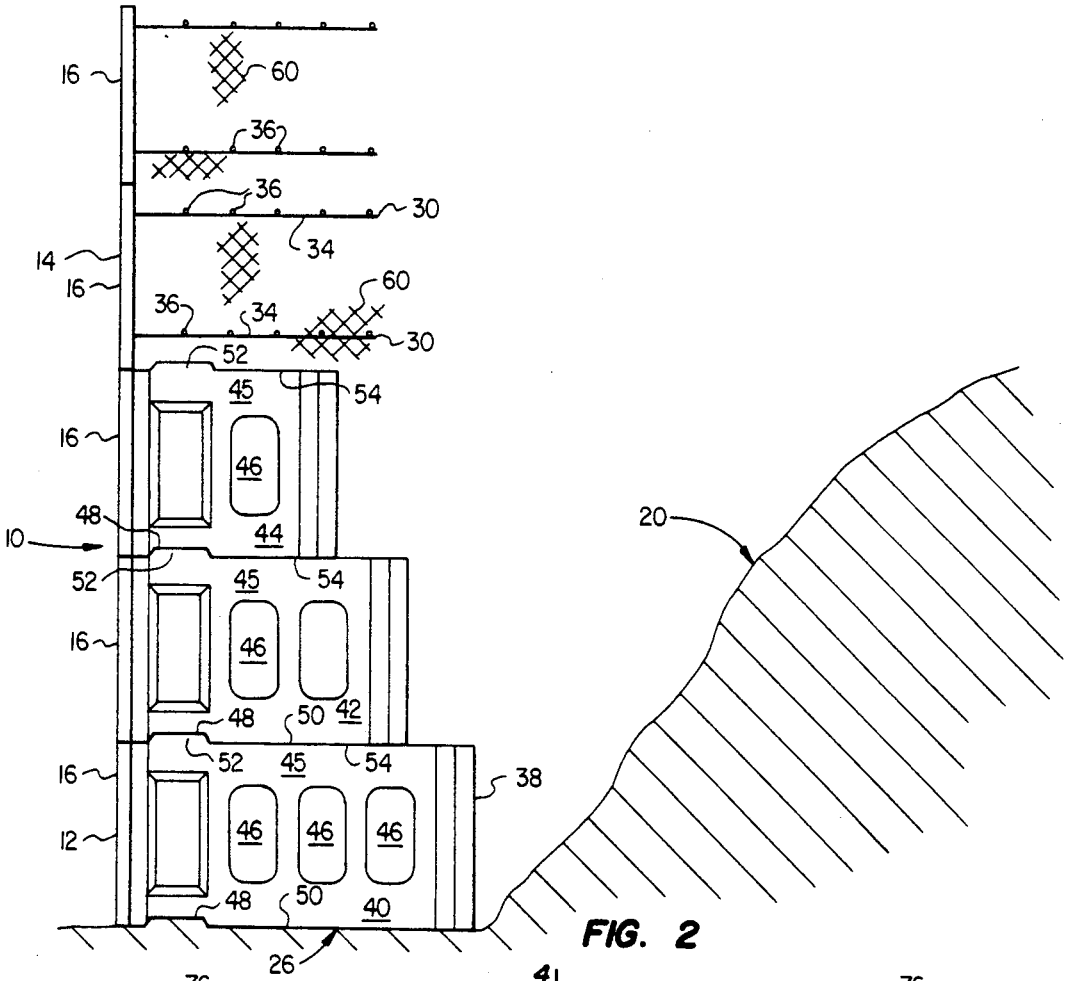
FIG. 2 is a side elevational cross sectional view of the retaining wall system of FIG. 1 illustrating various aspects of the construction thereof.

Referring now to FIG. 2, there is shown a side elevational view of the wall system 10 of the present invention. Slope 20 is shown to engage the rear surface 38 of a lowermost retaining wall member 40 disposed atop earth and surface 26. Earth and surface 26 may be established by grading, backfill or other conventional construction methods including generation of a select foundation where necessary. Above gravity wall member 40 is a second, shorter gravity wall member 42 above which is a third, yet shorter, gravity wall member 44. Each of the wall members of the gravity wall system 12 includes a face panel 16 disposed outwardly therefrom and a rearwardly extending embedment beam 45 extending orthogonally therefrom. Embedment beam 45 includes a plurality of apertures 46 that are, in this particular embodiment, provided to reduce the weight of the embedment beam. Other weight reducing designs could also be implemented, and where greater weight is required, select ones of the apertures may be eliminated. Likewise, the embedment beams of the present embodiment are constructed for interconnecting one with the other. A notch 48 is thus provided along the lower surface 50 of each embedment beam although such interconnection notches may not always be necessary. The recess or notch 48, when used, is adapted for matingly engaging a raised section, or shoulder, 52 formed in the top surface 54 of the underlying embedment beam. In this way, the longitudinal stability of the gravity wall system 12 may be assured when necessary.

Referring still to FIG. 2, there is shown above topmost gravity wall member 44 two rows of soil reinforced retaining wall sections 14. Section 14 comprises a face panel 16 from which extends a tether array 30. In the present drawing tether array 30 is comprised of the metal grid 32 having rearwardly extending members 34 connected with transversely extending members 36. The presence of soil mass 60 is diagrammatically shown in and around both retaining wall assembly sections 12 and 14 for purposes of clarity. It should be understood that the assembly of the retaining wall within the soil mass 60 is effected in stages whereby soil 60 is filled and compacted around each layer during the assembly process.

Figure 3:
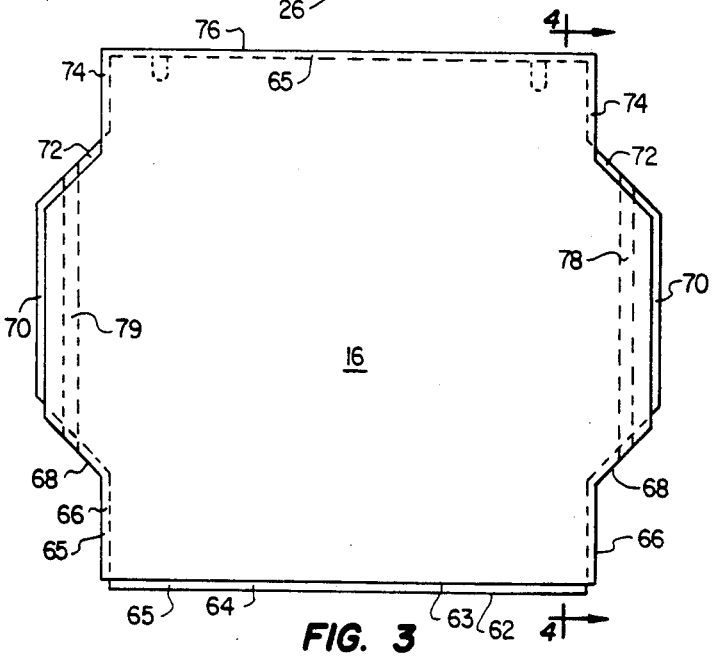
FIG. 3 is an enlarged front elevational view of the concrete face panel of FIG. 1 illustrating the mounting lip formed therearound.

Referring now to FIG. 3, there is shown a concrete panel 16 of the type utilized with either an embedment beam 45 or a tether array 30, neither of which may be seen in this figure. The concrete panel 16 comprises a bottom edge 62 having an offset region 64 generating a lip 65 therealong. Lip 65 may be seen to be formed along all sides of the panel 16 which, in the present invention, is a twelve-sided member. Any number of shapes for the panel 16 are contemplated in accordance with the principles of the present invention. When viewing the present panel 16 in a vertical configuration, as shown in FIG. 3, bottom edges 62 and 63 underlie upstanding vertical edges 66 formed on opposite sides of the panel 16. Tapered edges 68 expand outwardly one from the other symmetrically thereacross and terminate in vertical edges 70 upstanding therefrom. Vertical edges 70 terminate in inwardly tapering shoulders 72 which terminate in upwardly extending neck edges 74. Top edge 76 of the panel 16 is substantially straight and disposed in generally parallel space relationship with bottom edge 62. Lip 65 is, however, formed along each edge as shown herein in both solid and phantom lines. The phantom lines represent the hidden lip 65 generated by the offset region 64 formed around the surface of the panel 16 to facilitate interlocking engagement with adjacent panels 16. During the assembly, alignment pins (not shown) may be utilized and elongated apertures 78 and 79 are provided therethrough for that purpose. During the assembly operation shafts are disposed in the apertures 78 and 79 which are positioned in alignment one with the other for securement of said assembled face panels 16 in the above-referenced interlocking relationship therebetween.

Figure 4:
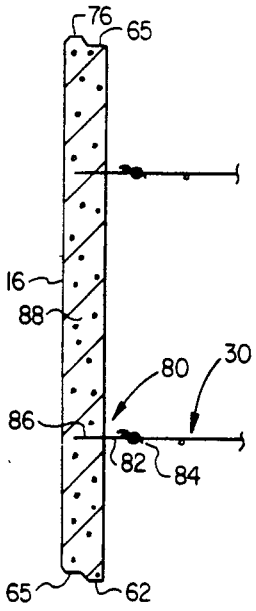
FIG. 4 is a side elevational cross-sectional view of the face panel of FIG. 3 taken along lines 4—4 thereof.

Referring now to FIG. 4, there is shown a side elevational, cross-sectional view of the panel 16 of FIG. 3 taken along lines 4—4 thereof. As may be seen in this figure, panel 16 includes lower edge 62 for which a lip 65 is provided in association therewith. A similar lip 65 is formed on the top edge 76 of panel 16. Connection means 80 are provided for securing the panel 16 to a tether array 30. A connector wire 82 thus extends rearwardly of panel 16 forming an interconnection loop 84. Portion 86 of wire 82 embedded within panel 16 is formed with a curved section 87, shown in more detail below, affording secured rigidity therewith. The concrete 88 thus provides a solid mass from which connection means 80 may provide structural rigidity in its engagement with tether array 30.

Figure 5:
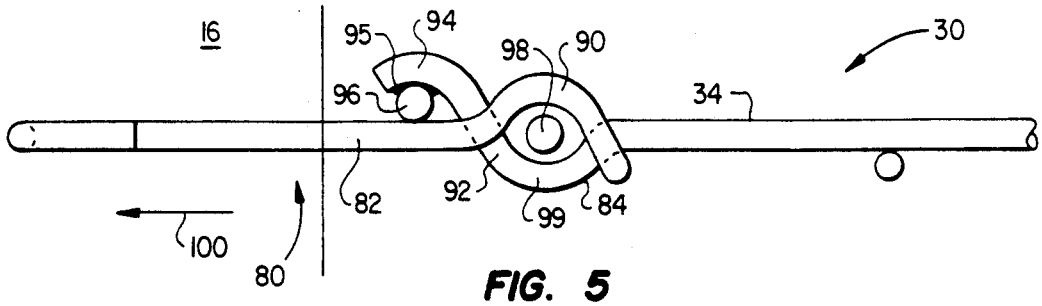
FIG. 5 is an enlarged side elevational, fragmentary view of the panel and connecting loop of FIG. 4 illustrating the connection of the soil reinforcement member to the face panel.

Referring now to FIG. 5, the connection means 80 is shown in an enlarged side elevational fragmentary cross-sectional view. The connector 84 seen to be formed of a loop section 90 formed in the end of wire 82. The metal wire or rod 34 of tether array 30 is likewise formed with a generally S-shaped loop end 92. The distal end 94 of loop 92 has received transversely therebeneath a rod 96. In the present embodiment, rod 96 is welded to loop end 94, and a weld 95 is shown securing the rod 96 to loop end 94. A similar tie-rod 98 is disposed between loop section 90 and lower body section 99 of S-shaped region 92 of wire 34. In this way an interlocking engagement between the tether array 30 and the concrete panel 16 is provided. Force in the direction of arrow 100 will thus be resisted by the tether array 30, which force will be transmitted through the loop sections 92 and 90 as discussed above.

Figure 6:
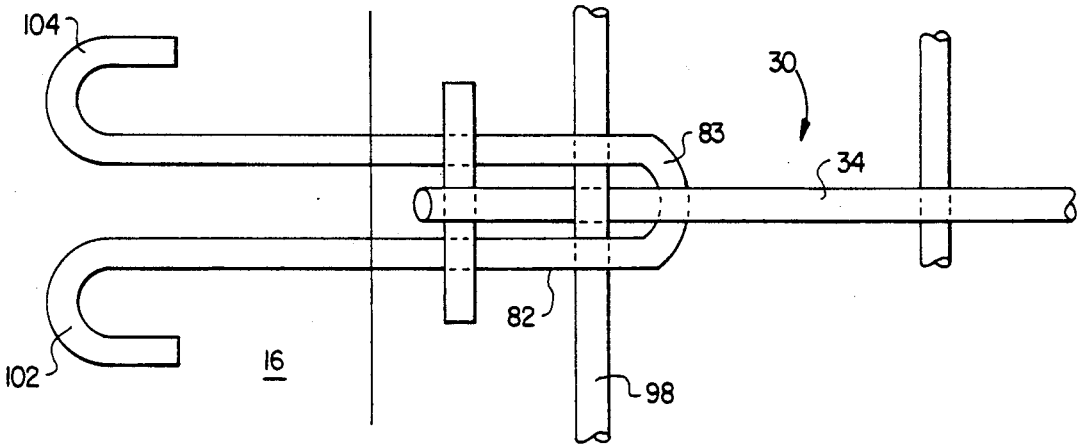
FIG. 6 is a top plan view of the soil reinforcement connection of FIG. 5.

Referring now to FIG. 6, there is shown a top plan view of the connection member of FIG. 5. Tie-rod 98 is shown to extend beneath wire 82. Wire 82 is shown to be formed with a frontal loop 83 that passes beneath the wire 34 of tether array 30 to extend rearwardly in generally parallel spaced relationship with itself for embedment within the concrete panel 16. The embedment shown herein is provided in curved ends 102 and 104 which are both formed in loops. With this looped connection embodiment, an interlocking configuration is provided between the soil reinforcement members 30 and the face panel 16 to sufficiently withstand the loads that would normally be encountered by such retaining walls. Of course, the size and length of member 30, and type of material in member 30 and panel 16 will vary depending on the loads encountered.

Figure 7:
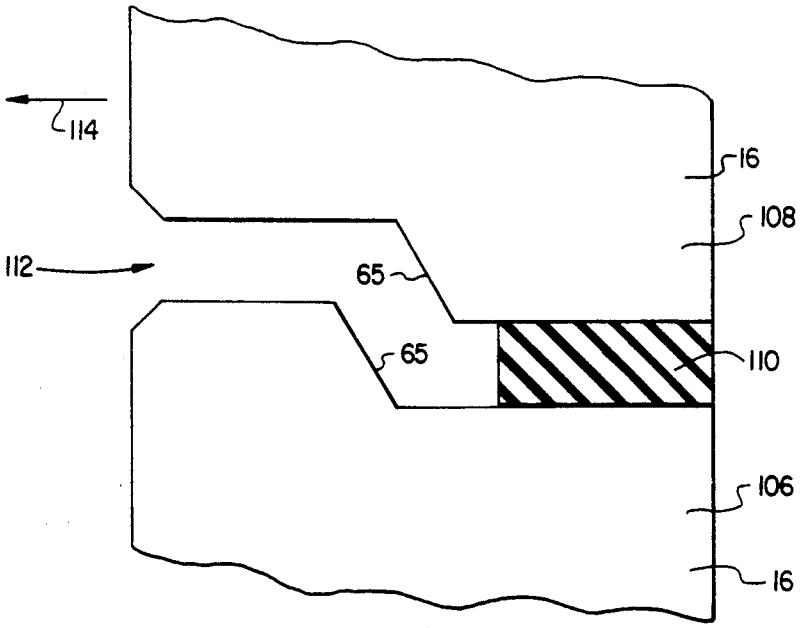
FIG. 7 is an enlarged side elevational cross-sectional view of the intersection of the two panels of FIG. 1 taken along lines 7—7 thereof.

Referring now to FIG. 7, there is shown an enlarged side elevational, cross-sectional view of two adjacent panels 16 from FIG. 1. Underlying panel 106 is separated from a panel 108 disposed thereabove by a spacer pad 110 disposed therebetween. Spacer pad 110 is formed of PVC plastic or the like and is positioned to generate a space 112 between panels 16. In this configuration it may be seen that the interlocking lips 65 may not engage one another during the initial construction. Engagement may only occur should panel 108 shift forward in the direction of arrow 114 relative to underlying panel 106.

Referring back to FIGS. 1 and 2 in combination, the retaining wall assembly 10 provides both a structurally sound and aesthetically pleasing vertical reinforcement wall relative to slope 20 and the backfill region 18 and 28 therearound. The panel 16 in the lowermost region of the retaining wall assembly 10 may include half panel sections 120 such as those shown herein. The half panel sections 120 shown herein are provided for accommodating the vertically staggered assembly between adjacent vertical rows of panel 16. The panels 120 are connected to embedment beams (not shown) that are of reduced vertical height, but of substantially identical shape as embedment beams 45 discussed above.

As shown most clearly in FIG. 1, the embedment beams 45 extending behind retaining wall system 12 are constructed in a generally I-shaped configuration. Rear wall section 122 of the beam 45 of FIGS. 1 and 2 is substantially planar in construction and may be integrally formed with the front panel 16 and the connecting, embedment beam 45. In one embodiment, a pre-cast concrete structure is formed, wherein the width of the rear wall section 122 may vary, depending on the application. As shown herein, sections of the rear wall 122 are cut-away for purposes of illustration. When the rear wall 122 is provided in a width that is somewhat less than or approximately equal to that of the front panel 16, a "crib wall" type assembly is formed. The width of the rear wall 122 can, of course, vary with each application and in the present embodiment it is less than the width of the face panel 16. Earth filled within the confines of rear wall 122 and front panel 16 thus provides a large mass which will resist movement of the gravity wall system 12, the vertical members of which may be interlocked one with the other. As discussed above, the top surface 54 of embedment beam 45, may include the shoulder 52 which mates with the notch 48. The presence of notch 48 beneath the retaining wall section 14 is illustrative of the compatibility between the two systems in that the presence of one does not affect the presence of the other. Moreover, the variation in length of the embedment beams 40, 42 and 44 is illustrative of the reduced loading necessary for the embedment beams at a higher vertical height relative to the slope 20. Consistent with the above-described principles of the present invention, the combination retaining wall assembly 10 is able to accommodate a wide variation in retaining wall applications while providing a facade of wall panels 16 indicating but a single type of retaining wall securement techniques therebehind.

It is thus believed that the operation and construction of the present invention will be apparent from the foregoing description. While the method and apparatus shown or described have been characterized as being preferred it will be obvious that various changes and modifications may be made therein without departing from the spirit and scope of the invention as defined in the following claims.

What is claimed is:

1. A retaining wall system for securing a soil mass relative thereto, said system comprising:

at least one gravity retaining wall member, said gravity wall member having a first face panel and a rearwardly extending embedment beam;

a second face panel and means for securing said second face panel to said soil mass, said securing means comprising a tether array connected at a first end to said second face panel and a second end extending into said soil mass; and means for mounting said second face panel upon said first face panel for the creation of a common retaining wall therebetween.

2. The apparatus as set forth in claim 1 wherein said gravity wall member comprises a generally I-shaped concrete structure wherein said embedment beam further includes a top, rear and bottom surface with said first face panel integrally formed therewith, said top surface being constructed with a first raised section adapted for matingly engaging the bottom surface of an embedment beam disposed thereabove.

3. The apparatus as set forth in claim 2 wherein said bottom surface of said embedment beam further includes a recessed portion adapted for matingly receiving in interlocking engagement said raised portion of an embedment beam disposed therebelow.

4. The apparatus as set forth in claim 2 wherein said rear surface of said embedment beam further includes a generally planar wall section having a width less than the width of said first face panel and being disposed in generally parallel spaced relationship thereto.

5. The apparatus as set forth in claim 1 and including a plurality of gravity retaining wall members assembled side by side and one atop another.

6. The apparatus as set forth in claim 1 wherein said tether array includes connecting members secured thereto at said first end thereof, said connecting members being adapted for the securement of said tether array to said second face panel.

7. The apparatus as set forth in claim 6 wherein said tether array comprises a grid adapted for soil mass embedment.

8. The apparatus as set forth in claim 6 wherein said tether array comprises a series of filaments adapted for embedment in said soil mass.

9. The apparatus as set forth in claim 6 wherein said connecting members comprise metal loops encased within said face panel, said tether array comprising a plurality of wire members in an interlocking grid configuration, and said wire members being coupled to said loops.

10. The apparatus as set forth in claim 9 wherein select wires of said grid terminate along a grid engagement region, said wire forming a generally arcuate shape adapted for matingly engaging said loops of said connecting members, and a tie rod being disposed between said loops and said arcuate wire ends for defining an interlocking relationship therebetween.

11. The apparatus as set forth in claim 1 wherein said face panels are formed from concrete in an interlocking configuration and further include a spacer pad disposed therebetween, said spacer pad defining a separation space between said interlocking face panels.

12. The apparatus as set forth in claim 1 wherein said face panels are constructed for interlocking engagement, one with the other.

13. The apparatus as set forth in claim 1 wherein said face panels are constructed with at least one conduit therethrough, said conduit adapted for being vertically oriented upon assembly of said panels with said conduits in registry one with the other for receiving an alignment shaft therein to facilitate the assembly thereof.

14. An improved method of erecting a retaining wall comprising a plurality of pre-cast concrete face panels of the type wherein said face panels are secured in a generally vertical configuration and structurally secured to a soil mass disposed therebehind for maintaining said soil mass adjacent thereto, said improvement comprising the steps of:

providing a plurality of first face panels adapted for establishing a first retaining wall section;

providing means for securing said first face panel to said soil mass, said securing means comprising a tether array connected at a first end to said first face panel and a second end extending into said soil mass;

providing a plurality of second face panels with embedment beam assemblies extending rearwardly thereof;

disposing a plurality of second face panel and embedment beam assemblies in a first position for establishing a first lower retaining wall section;

filling soil mass around and atop said embedment beams;

disposing a plurality of first face panel and securing means atop said second face panel and embedment beam assemblies; and filling soil mass around said tether array of said securing means and above said embedment beams to define a combination retaining wall comprised of embedment beams and soil reinforcement members.

15. The method as set forth in claim 14 wherein said second face panels are integrally formed with said embedment beams and said step of providing said second face panels includes the step of casting said panels and beam elements from concrete.

16. The method as set forth in claim 15 wherein said cast panel and beam elements comprise generally I-shaped pre-cast concrete structures and said casting step includes forming a top surface of said beam with a first raised section adapted for matingly engaging the bottom surface of an embedment beam disposed thereabove.

17. The method as set forth in claim 16 and further including the step of forming the bottom surface of said beam with a notched portion adapted for matingly receiving in interlocking engagement said first raised section and the step of positioning one beam upon another in interlocking engagement therebetween.

18. The method as set forth in claim 14 wherein said tether array comprises at least two rearwardly extending soil mass engagement tethers and the step of disposing said first face panels and securing means includes the steps of filling soil substantially up to the level of each tether of said array, extending each tether rearwardly of said first face panels when said soil is adjacent thereto, and filling soil above said extended tether.

19. The method as set forth in claim 18 wherein each of said tethers comprises a grid adapted for soil embedment and said step of extending said tether includes the step of filling soil to a substantially level configuration, laying said grid upon said substantially level soil and filling more soil above said grid for the securement thereof.

20. The method as set forth in claim 18 and further including the steps of providing tether connection members for said first face panels, said connection members comprising wire loops, and the step of encasing said loops in said first panels.

21. A retaining wall system for securing a soil mass relative thereto, said system comprising:

at least one gravity retaining wall member, said gravity wall member having a face panel and a rearwardly extending embedment beam;

said gravity wall member comprising a generally I-shaped concrete structure wherein said embedment beam further includes a top, rear and bottom surface, said top surface being constructed with a first raised section adapted for matingly engaging the bottom surface of an embedment beam disposed thereabove;

at least one soil reinforcement retaining wall member having a face panel and at least one rearwardly extending soil reinforcement element;

said soil reinforcement member comprising a tether array and connecting members secured thereto, said connecting members being adapted for the securement of said tether array extending rearwardly therefrom into said soil mass; and means for mounting said soil reinforcement element upon said gravity wall member for the creation of a common retaining wall therebetween.

22. An improved method of erecting a retaining wall comprising a plurality of pre-cast concrete face panels of the type wherein said face panels are secured in a generally vertical configuration and structurally secured to a soil mass disposed therebehind for maintaining said soil mass adjacent thereto, said improvement comprising the steps of:

providing a plurality of first face panels adapted for securement to said soil mass by at least one soil reinforcement tether disposed rearwardly thereof for soil mass engagement;

providing a plurality of second face panels having embedment beams disposed rearwardly thereof adapted for securement in said soil mass;

forming said second face panel and beam elements in a generally I-shaped pre-cast concrete structure, including the step of casting a top surface of said beam with a first raised section adapted for matingly engaging the bottom surface of an embedment beam disposed thereabove;

disposing a plurality of second face panel and embedment beam assemblies in a first position for establishing a first lower retaining wall section;

filling soil mass around and atop said embedment beam;

disposing a plurality of first face panel and soil reinforcement tether assemblies atop said panel and embedment beam assemblies;

filling soil above said embedment beam assemblies substantially up to the level of said tether, extending said tether rearwardly of said first face panels; and filling soil mass around said extended tether and above said embedment beams to define a combination retaining wall comprised of embedment beams and soil reinforcement members.

* * * * *

UNITED STATES PATENT AND TRADEMARK OFFICE

CERTIFICATE OF CORRECTION

PATENT NO. : 5,131,791
DATED : July 21, 1992
INVENTOR(S) : James K. Kitzmiller

It is certified that error appears in the above-identified patent and that said Letters Patent is hereby corrected as shown below:

Title page, item [75] Delete "James K. Kitziller"
Insert --James K. Kitzmiller--

Signed and Sealed this

Twelfth Day of October, 1993

*Attest:*

*Attesting Officer*

BRUCE LEHMAN

*Commissioner of Patents and Trademarks*